US011174764B2

(12) United States Patent
Enström et al.

(10) Patent No.: US 11,174,764 B2
(45) Date of Patent: Nov. 16, 2021

(54) METHOD FOR CONTROLLING THE OIL PRESSURE OF AN OIL PUMP IN A COMBUSTION ENGINE AND AN OIL PRESSURE ARRANGEMENT

(71) Applicant: VOLVO TRUCK CORPORATION, Gothenburg (SE)

(72) Inventors: Anders Enström, Tostared (SE); Magnus Horn, Särö (SE); Lars Kastensson, Gothenburg (SE)

(73) Assignee: VOLVO TRUCK CORPORATION, Gothenburg (SE)

( * ) Notice: Subject to any disclaimer, the term of this patent is extended or adjusted under 35 U.S.C. 154(b) by 49 days.

(21) Appl. No.: 16/603,086

(22) PCT Filed: Apr. 12, 2018

(86) PCT No.: PCT/EP2018/025113
§ 371 (c)(1),
(2) Date: Oct. 4, 2019

(87) PCT Pub. No.: WO2018/188816
PCT Pub. Date: Oct. 18, 2018

(65) Prior Publication Data

US 2020/0049034 A1 Feb. 13, 2020

(30) Foreign Application Priority Data

Apr. 13, 2017 (EP) ..... 17166543

(51) Int. Cl.
*F01M 13/04* (2006.01)
*F01M 1/02* (2006.01)
(Continued)

(52) U.S. Cl.
CPC ..... *F01M 1/02* (2013.01); *F01M 1/16* (2013.01); *F01M 3/00* (2013.01); *F01M 13/04* (2013.01)

(58) Field of Classification Search
CPC ..... F01M 13/028; F01M 13/04; F01M 1/02; F01M 1/16; F01M 2013/0422; F01M 2250/62; F01M 2250/64; F01M 3/00
(Continued)

(56) References Cited

U.S. PATENT DOCUMENTS 3,800,754 A * 4/1974 Carlson ..... F02M 69/10 123/73 CB
4,424,709 A * 1/1984 Meier, Jr. ..... G01M 15/09 701/102
(Continued)

FOREIGN PATENT DOCUMENTS

CN 104594976 A 5/2015
CN 105189950 A 12/2015
(Continued)

OTHER PUBLICATIONS

International Search Report and Written Opinion dated Jul. 11, 2018, issued in International Application No. PCT/EP2018/025113.
(Continued)

*Primary Examiner* — George C Jin
*Assistant Examiner* — Teuta B Holbrook
(74) *Attorney, Agent, or Firm* — Venable LLP; Jeffri A. Kaminski

(57) ABSTRACT

The invention relates to a method for controlling the oil pressure of an oil pump (40, 140) in a combustion engine (100). The combustion engine (100) comprises a crankcase (11) and a separator (14, 114) for separating oil present in a blow-by gas from the crankcase (11). The method comprises the step (201) of providing oil pressure demand for a set of
(Continued)

different engine operation conditions, the oil pressure demand defining the theoretical required oil pressure of the oil pump (40, 140); the step (203) of controlling the oil pressure of the oil pump (40, 140) based on the oil pressure demand for at least one engine operation condition in the set of different engine operation conditions; the step (205) of driving the separator (14, 114) using oil from the oil pump (40, 140), the oil being pressurized based on the oil pressure demand.

12 Claims, 6 Drawing Sheets

(51) Int. Cl.
*F01M 1/16* (2006.01)
*F01M 3/00* (2006.01)

(58) Field of Classification Search
USPC .... 123/41.86, 572–574, 196 A; 55/330, 345, 55/346, 348, 350.1, 400–403, 406, 408; 95/268–270, 273, 277
See application file for complete search history.

(56) References Cited

U.S. PATENT DOCUMENTS 5,884,601 A * 3/1999 Robinson ..... F01M 5/025 123/196 S
7,338,546 B2 * 3/2008 Eliasson ..... B01D 45/14 55/406
8,893,689 B2 * 11/2014 Dawar ..... F02M 25/06 123/573
9,545,591 B2 * 1/2017 Parikh ..... B01D 46/2403
2011/0011380 A1 * 1/2011 Lagerlof ..... F01M 13/04 123/573
2013/0151113 A1 6/2013 Chung
2014/0018227 A1 * 1/2014 Andersson Aginger ..... B04B 5/12 494/43
2016/0356188 A1 * 12/2016 Hashimoto ..... F01M 1/16
2017/0044938 A1 * 2/2017 Rotter ..... F01M 11/12
2017/0074131 A1 * 3/2017 Ritter ..... F01M 5/005
2019/0211721 A1 * 7/2019 Kirschner ..... F01M 13/00

FOREIGN PATENT DOCUMENTS

CN 206054027 U 3/2017
DE 102014222505 A1 12/2015
EP 2638944 A1 9/2013
JP 2015203370 A 11/2015
WO 2015124160 A1 8/2015

OTHER PUBLICATIONS

China Office Action dated Nov. 30, 2020 for corresponding China Patent Application No. 201880024532.5, 10 pages.

* cited by examiner

METHOD FOR CONTROLLING THE OIL PRESSURE OF AN OIL PUMP IN A COMBUSTION ENGINE AND AN OIL PRESSURE ARRANGEMENT

TECHNICAL FIELD

The invention relates to a method for controlling the oil pressure from an oil pump in a combustion engine and using the oil for driving a separator separating oil present in a blow-by gas from a crankcase, to an oil pressure arrangement for a combustion engine, and to a vehicle comprising such oil pressure arrangement. The invention further relates to a computer program, a computer readable medium carrying a computer program, to a control unit for controlling the oil pressure of a controllable oil pump configured for driving at least a separator for separating oil present in blow-by gas from a crankcase, and to the use of oil pressure demand for controlling the oil pressure of an oil pump in a combustion engine.

BACKGROUND

During operation of an internal combustion engine, small amount of unburned fuel and exhaust gases typically escape around the piston rings and enter the crankcase, which is known as "blow-by" or "blow-by gases". Thus, the crankcase needs to be ventilated in a controlled manner in order to avoid unwanted and uncontrolled leakage of the blow-by gases and/or to avoid condensation of the blow-by gases inside the crankcase causing dilution and degrading of the crankcase with the effect of a decreased ability to lubricate. Thus, the combustion engine is often equipped with a crankcase ventilation system, commonly abbreviated as a CCV system.

The CCV system may e.g. comprise a channel for discharging the blow-by gases out from the crankcase, an oil separating device separating the oil from the remaining gases, one or more valves, and a channel connecting the CCV system to an intake of the engine, e.g. as is disclosed in WO 2015/124160.

However, the CCV system, and especially the oil separating device of the CCV system, requires a relatively high energy input for separating the oil in the blow-by gases. There is thus a need in the industry for further improvements of the CCV system.

SUMMARY

In view of the above-mentioned and other drawbacks of the prior art, the object of the present inventive concept is to provide a more energy-efficient oil separation of the blow-by gases in the crankcase, and more specifically to provide a more energy-efficient operation of the oil pressure pump in the engine. The object is achieved by a method according to claim 1.

According to a first aspect of the invention, a method for controlling the oil pressure of an oil pump in a combustion engine, said combustion engine comprising a crankcase and a separator for separating oil present in a blow-by gas from the crankcase. The method comprises the steps of providing oil pressure demand for a set of different engine operation conditions, said oil pressure demand defining the theoretical required oil pressure of said oil pump;

controlling the oil pressure of said oil pump based on said oil pressure demand for at least one engine operation condition in said set of different engine operation conditions;

driving the separator using oil from said oil pump, said oil being pressurized based on said oil pressure demand.

By the provision of a method which comprises the step of driving the separator using oil from said oil pump, where the oil is pressurized based on oil pressure demand, the separator can be driven in a more energy-efficient manner. That is, the advantage of driving the separator based on oil pressure demand, is that the oil pressure can be adapted, and hence the oil pump can be operated using less fuel, based on the needs, or the requirements of the engine. Hence, the separator is driven using pressurized oil in accordance with the oil pressure demand. This is contrary to prior art solutions in which the separator is operated with a fixed speed. That is, for an oil driven separator, driven by oil which is pressurized to a fixed value. In order to manage all engine operation conditions, such fixed speed, or such fixed value of the oil pressure, is set based on a full load condition. However, according to the invention, by operating the separator based on an oil pressure demand, unnecessary overload operation of the separator (e.g. in an engine operation condition not being a full load condition), which otherwise would occur for the fixed speed driven separator, can be avoided. Thus, according to at least one example embodiment, the method comprises the step of operating the separator based on the different engine operation conditions or comprises the step of varying the speed of the separator based on the different engine operation conditions. Thus, the method of the first aspect of the invention may be referred to as a method for operating a separator in a combustion engine.

Described differently: the separator is driven by the oil in the engine, e.g. referred to as engine oil or main gallery engine oil, and the amount of blow-by gases which the separator can handle is related to the oil pressure of the oil driving the separator, where a higher oil pressure typically is related to a higher amount of blow-by gases. The oil pressure is dependent on the operation of the oil pump, and a higher oil pressure is typically related to a higher consumption of energy (e.g. fuel) of the oil pump. Thus, by providing an oil pressure demand, which is based on the theoretical required oil pressure for a set of different engine operation conditions, the operation of the oil pump (i.e. the oil pressure) can be adapted accordingly, and energy can be saved. Thus, and according to one embodiment, the operation of the separator is adapted to different engine operation conditions. It should be understood that according to the invention, the separator is an oil-driven separator.

According to one embodiment, the method comprises the step of controlling the oil pressure of said oil pump based on said oil pressure demand for at least two different engine operation conditions in said set of different engine operation conditions, and driving the separator using oil from said oil pump, said oil being pressurized based on said oil pressure demand, for said at least two different operation conditions. That is, according to one example, for a first engine operation condition, a first oil pressure is needed based on said oil pressure demand, and for a second engine operation condition being different to said first operation condition, a second oil pressure is needed based on said oil pressure demand, wherein said method comprises controlling the oil pressure of said oil pump to correspond to said first and second oil pressure, respectively, and thus driving said separator using oil pressurized according to said first and second oil pressure, respectively.

According to one embodiment, said step of providing oil pressure demand comprises determining the theoretical required oil pressure for said set of different engine operation conditions based on at least the engine load and/or engine speed.

Hereby, the engine load and/or the engine speed, at least partly defines the different engine operation conditions, and the theoretical required oil pressure is thus based on at least the engine load and/or the engine speed. For example, the amount of blow-by gases is related to the engine load and/or the engine speed, such that a relatively high engine load and/or a relatively high engine speed result in a relatively high amount of blow-by gases, whereby the separator requires a relatively high oil pressure in order to handle the relatively high amount of blow-by gases. Thus, the oil pump is operated to correspond to the oil pressure required by the separator to handle the relatively high amount of blow-by gases. Correspondingly, a relatively low engine load and/or a relatively low engine speed result in a relatively low amount of blow-by gases, whereby the separator requires a relatively low oil pressure in order to handle the relatively low amount of blow-by gases. Thus, the oil pump is operated to correspond to the oil pressure required by the separator to handle the relatively low amount of blow-by gases. Thus, the energy input (e.g. fuel) to the oil pump can be varied in order to correspond to the oil pressure required by the separator. That is, and according to one embodiment, the said step of providing oil pressure demand comprises determining the theoretical required oil pressure based on at least the amount of blow-by gases in the crankcase. The amount of blow-by gases may for example be determined based on empirical studies for a specific engine, or engine type, and the engine load and/or engine speed. According to another example, the amount of blow-by gases is determined based on a sensor arranged and configured to determine the amount of blow-by gases in the crankcase.

According to one embodiment, the operation of at least one component in the combustion engine requiring oil for lubrication, at least partly defines the different engine operation conditions. For example, the degree of piston cooling, the operation of the turbo charger and/or the air compression may at least partly define the different engine operation conditions, e.g. when any one of these components is requiring the highest oil pressure within the combustion engine. According to another example, the oil temperature at least partly defines the amount of oil in the blow-by gases, and hence the oil temperature may at least partly define the different engine operation conditions. However, according to one example embodiment, and for the purpose of providing a sufficient oil pressure to the separator, the engine load and/or engine speed is sufficient for defining the engine operation conditions in said set of different engine operation conditions.

According to one embodiment, the oil pressure required by the separator determines the oil pressure demand for at least one, or at least two, of the engine operation conditions in said set of different engine operation conditions. That is, in the engine, the separator may be the component requiring the highest oil pressure, and thus determines the required oil pressure to be delivered by the oil pump, for at least some engine operation conditions in said set engine operation conditions. However, it should be noted that another component, or another function, in the engine other than the separator, may set the oil pressure demand, i.e. determines the required oil pressure to be delivered by the oil pump, for at least one engine operation condition in said set of the different engine operation conditions. In other words, the oil pressure demand may comprise the theoretical required oil pressure of the combustion engine determined by different components and/or functions in the engine. The component and/or function determined the theoretical required oil pressure is typically the component and/or function which at the current engine operation condition is requiring the highest oil pressure in the combustion engine. For example, and according to one embodiment, the separator is the component and/or function requiring the highest oil pressure in the combustion engine for at least one, two, some or all of the engine operation conditions in said set of different engine operation conditions. Thus, for such embodiments, the oil pressure demand is at least partly correlated to the required oil pressure of the separator.

According to one embodiment, said oil pressure demand for said set of different engine operation conditions is predetermined. That is, the oil pressure demand may be determined on beforehand, for example based on empirical studies and/or be based on theoretical calculations. According to one example, the method comprises the step of determining the oil pressure demand of said engine and/or said engine type. For example, the engine, or a typical engine of a specific engine type, may be set up in an engine test-rig which is run according to the engine operation conditions in said set of different engine operation conditions. For each different engine operation condition in the set of different engine operation condition, the theoretical required oil pressure from said oil pump is determined. This may for example be based on the separators ability to handle the blow-by gases in the crankcase, as previously described, and/or be based on the required oil pressure of another component or function in the engine. The required oil pressure for the different engine operation conditions in said set of different engine operation conditions, for the specific engine, or engine type, may thus be determined and saved/stored, and subsequently used during normal operation of the engine.

It should be noted that the terms "theoretical required oil pressure" and "required oil pressure" are used interchangeably throughout the application text, and are commonly referring to the respective component's (often the separator's), or engine's, required oil pressure to fulfil its respective purpose. As mentioned above, the separator is often the component in the engine requiring the highest oil pressure, and thus sets the upper limit of the oil pressure needed to be delivered from the oil pump.

According to one embodiment, said step of providing oil pressure demand comprises providing an oil pressure map, said oil pressure map determining the theoretical required oil pressure for said set of different engine operation conditions based on at least the engine load and the engine speed.

That is, the theoretical required oil pressure is based on at least the engine load and the engine speed. That is, at least two parameters can be used to define the oil pressure demand. Thus, and according to one embodiment, the oil pressure map corresponds to a 3D map, which can be described in an x, y, z-coordination system in which the x-axis represents the engine speed, the y-axis represents the engine load, and the z-axis represents the theoretical required oil pressure. The oil pressure map may be determined by using an engine test-rig as previously described.

According to one embodiment, the method is characterized by the further step of detecting a first output signal of a pressure sensor arranged and configured to measure the oil pressure downstream of said oil pump, said first output signal being indicative of a first engine operation condition in said set of different engine operation conditions.

The pressure sensor is preferably arranged and configured to measure the oil pressure of the oil used to drive the separator, i.e. the separator input oil or the driving input oil to the separator. This may e.g. be the case when the pressure sensor, such as e.g. the main gallery engine oil pressure sensor, is arranged in close proximity to the separator, so that any pressure drop between the pressure sensor and the separator is neglectable. However, the pressure sensor may be arranged to measure the oil pressure further upstream of the separator, and by means of pressure drop calculations, determine the oil pressure of the separator input oil, or the driving input oil to the separator. Such pressure drop calculations may be carried out in advance and added to the required oil pressure of the separator, or such pressure drop calculations may be carried out in a control unit, or an engine control unit, connected to the pressure sensor. Hence, the pressure sensor is at least in fluid communication with the separator, and may according to one embodiment be arranged in said crankcase. According to one embodiment, the pressure sensor is arranged inside said crankcase. Additionally or alternatively, a separate pressure sensor is comprised in the engine with the main purpose of measuring the oil pressure of the oil used to drive the separator.

It should be noted that the oil driven by the oil pump, and the oil used for driving the separator is typically referred to as engine oil, or as main gallery engine oil. Hence, the pressure sensor may be referred to as a main gallery pressure oil sensor as it is arranged and configured to measure the oil pressure of the main gallery pressure oil.

According to one embodiment, the method is characterized by the further step of controlling the oil pressure of said oil pump by comparing said first output signal of said pressure sensor with said oil pressure demand for an engine operation condition corresponding to said first engine operation condition.

That is, the oil pressure of the oil pump may be controlled by combining said oil pressure demand and at least one actual measurement of the oil pressure by the oil pressure sensor. It should be understood that the same, or corresponding, engine operation condition is used during the comparison of said first output signal of said pressure sensor and said oil pressure demand, and that the respective value of the oil pressures is associated with the same position of the engine (e.g. the oil pressure at, or just before, the separator). In other words, and according to one embodiment the position or location of determined oil pressure in the oil pressure demand corresponds to the position or location of the pressure sensor.

According to one embodiment, said oil pressure demand comprises a plurality of reference values, wherein each one of the reference values represents the oil pressure associated with at least a specific position or location within the engine, and for at least one specific engine operation condition in the set of different engine operation conditions. For example, the oil pressure demand comprises a plurality of reference values indicating the oil pressure at, or just before, the separator, for a plurality of engine operation conditions in the set of different engine operation conditions. Thus, comparison may be carried out between said first output signal of said pressure sensor and at least one reference value in order to provide the control or regulation of said oil pump. In other words, controlling of the oil pump in the first engine operation condition described above, at least one reference value is taken from the theoretical required oil pressure in the oil pressure demand at an engine operation condition corresponding to said first engine operation condition.

According to one embodiment, a comparison between said first output signal of said pressure sensor and said oil pressure demand, or at least one of the reference values in the oil pressure demand, initiate a response action for said oil pump. Thus, the oil pump may be controlled or regulated based on the comparison. For example, if the pressure sensor for some reason measures a higher pressure than what is expected by the oil pressure demand, suitable correction for reducing the oil pressure of the oil pump may be included in the response action.

According to one embodiment, said separator comprises an oil separation member rotatably arranged in said separator, said oil separation member being rotated by a rotating means, characterized by the further step of driving said rotating means with oil from said oil pump, said oil being pressurized based on said oil pressure demand.

The oil separation member may for example be comprised of a disc or the like. According to one embodiment, said separator comprises a plurality of such oil separation members, such as e.g. a plurality of discs or the like. According to one embodiment, said rotating means is a turbine drive connector. Hence, the disc(s) or the like may be driven by the turbine drive connector using pressurized oil in accordance with the oil pressure demand.

It should be noted that the separator may be constructed differently, and for example, the oil driving the separator may be used to drive a pump in order to increase the pressure drop over a separation member, which in turn is used to separate oil from the blow-by gases. Other types of separators know to the skilled person may also be used within the scope of the invention.

According to one embodiment, the separator is part of the engine CCV-system.

According to a second aspect of the invention, the object is achieved by an oil pressure arrangement for a combustion engine according to claim 9. The oil pressure arrangement comprises a controllable oil pump configured for driving at least a separator for separating oil present in blow-by gas from a crankcase, and a control unit configured to control the oil pressure of said controllable oil pump wherein the control unit is configured to control the oil pressure based on oil pressure demand for at least one engine operation condition in a set of different engine operation conditions.

Hereby, the previously described control, or regulation, of the oil pump can be achieved, together with the corresponding oil pressure demand driven separator.

Effects and features of this second aspect of the present invention are largely analogous to those described above in connection with the first aspect of the inventive concept. Embodiments mentioned in relation to the first aspect of the present invention are largely compatible with the second aspect of the invention, of which some embodiments are explicitly disclosed below. Thus, according to one embodiment, said control unit is configured to perform the steps of the method according to the first aspect of the invention.

For example, and according to one embodiment, the oil pressure arrangement comprises a pressure sensor arranged and configured to measure the oil pressure downstream of said oil pump, said pressure sensor being configured to send a first output signal to said control unit, said first output signal being indicative of a first engine operation condition in said set of different engine operation conditions, wherein said control unit is configured to control the oil pressure of said controllable oil pump by comparing said first output signal of said pressure sensor with the oil pressure demand for an engine operation condition corresponding to said first engine operation condition. The previous discussion concerning said oil pressure demand comprising a plurality of reference values, and the use of said reference value according to the first aspect of the invention apply to the second aspect of the invention as well. Thus, the control unit of the oil pressure arrangement may be arranged to make a comparison between said first output signal of said pressure sensor and said oil pressure demand, or at least one of the reference values in the oil pressure demand, and initiate a response action for said oil pump. Thus, the oil pump may be controlled or regulated based on the comparison.

According to one embodiment, said controllable oil pump is controlled such that the oil pressure out from said controllable oil pump is controlled.

According to at least a third aspect of the present invention, the object is achieved by a vehicle according to claim 12. The vehicle comprising an oil pressure arrangement according to the second aspect of the invention.

Effects and features of this third aspect of the present invention are largely analogous to those described above in connection with the second aspect of the invention. Embodiments mentioned in relation to the first or second aspects of the present invention are largely compatible with the third aspect of the invention.

According to at least a fourth aspect of the present invention, the object is achieved by a computer program, the computer program comprising program code means for performing the steps of the first aspect of the invention, when said program is run on a computer. The computer may e.g. be the control unit of the second aspect of the invention.

Effects and features of this fourth aspect of the present invention are largely analogous to those described above in connection with the first aspect of the invention. Embodiments mentioned in relation to the first aspect of the present invention are largely compatible with the fourth aspect of the invention.

According to at least a fifth aspect of the present invention, the object is achieved by a computer readable medium, the computer readable medium carrying a computer program comprising program code means for performing the steps of the first aspect of the invention, when said program product is run on a computer. The computer readable medium may e.g. be comprised in the control unit of the second aspect of the invention.

Effects and features of this fifth aspect of the present invention are largely analogous to those described above in connection with the first aspect of the invention. Embodiments mentioned in relation to the first aspect of the present invention are largely compatible with the fifth aspect of the invention.

According to at least a sixth aspect of the present invention, the object is achieved by a control unit for controlling the oil pressure of a controllable oil pump configured for driving at least a separator for separating oil present in blow-by gas from a crankcase, the control unit being configured to perform the steps of the first aspect of the invention. The control unit may for example be that of the second aspect of the invention.

Effects and features of this sixth aspect of the present invention are largely analogous to those described above in connection with the first and second aspects of the invention. Embodiments mentioned in relation to the first and second aspects of the present invention are largely compatible with the sixth aspect of the invention.

According to at least a seventh aspect of the present invention, the object is achieved by the use of oil pressure demand for a set of different engine operation conditions, for controlling the oil pressure of an oil pump driving a separator for separating oil present in a blow-by gas from a crankcase in a combustion engine, said oil pressure demand defining the theoretical required oil pressure of the oil pump, for example described in relation to the first aspect of the invention.

Effects and features of this seventh aspect of the present invention are largely analogous to those described above in connection with the first and second aspects of the invention. Embodiments mentioned in relation to the first and second aspects of the present invention are largely compatible with the sixth aspect of the invention. For example, the oil pressure demand may be comprised in an oil pressure map.

Further advantages and advantageous features of the invention are disclosed in the following description and in the dependent claims.

BRIEF DESCRIPTION OF THE DRAWINGS

The above, as well as additional objects, features and advantages of the present invention, will be better understood through the following illustrative and non-limiting detailed description of exemplary embodiments of the present invention, wherein.

DETAILED DESCRIPTION OF EXAMPLE EMBODIMENTS OF THE INVENTION

Figure 1:
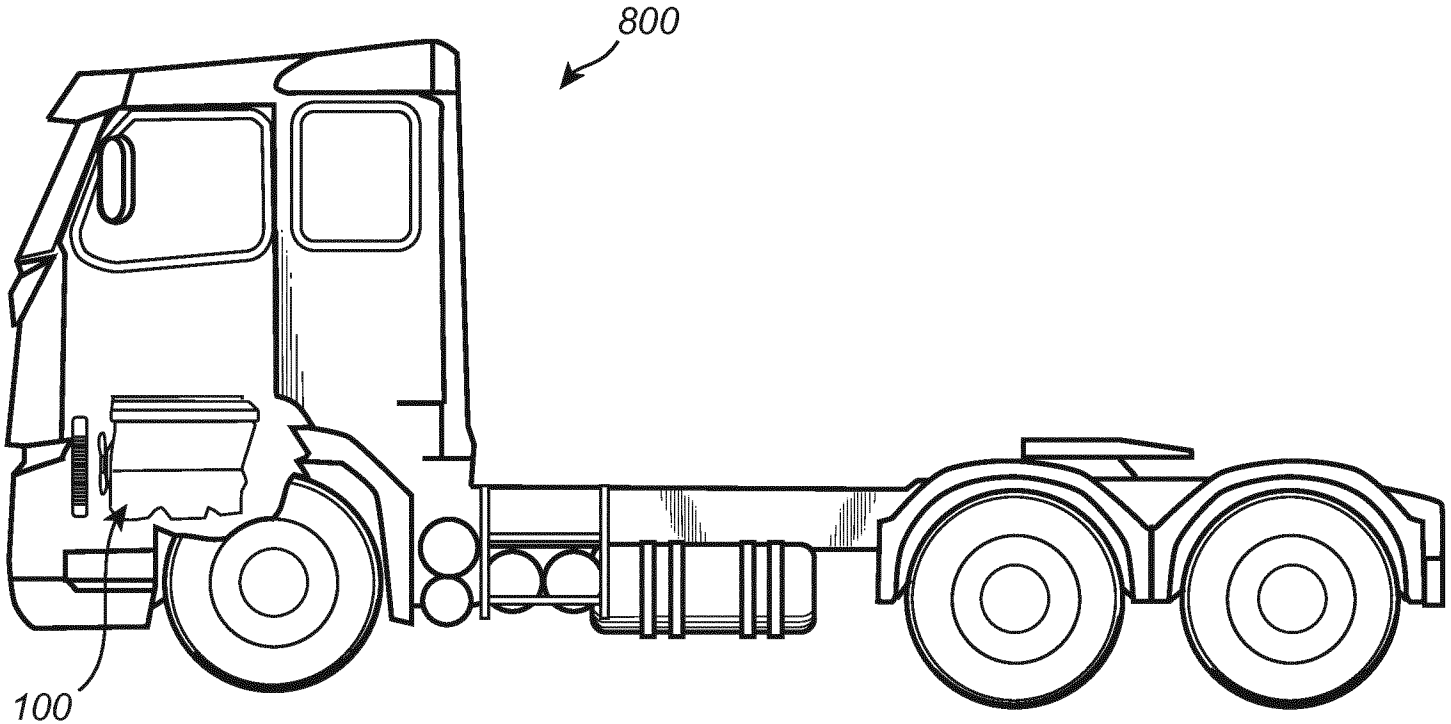
FIG. 1 is a side view of a vehicle comprising a combustion engine according to an example embodiment of the present invention.

The present invention will now be described more fully hereinafter with reference to the accompanying drawings, in which an exemplary embodiment of the invention is shown. The invention may, however, be embodied in many different forms and should not be construed as limited to the embodiment set forth herein; rather, the embodiment is provided for thoroughness and completeness. Like reference character refer to like elements throughout the description.

With particular reference to FIG. 1, there is provided a vehicle 800 with a combustion engine 100, such as an internal combustion engine 100, according to the present invention. The vehicle 800 depicted in FIG. 1 is a truck 800 for which the inventive concept which will be described in detail below, is particularly suitable for.

Figure 2:
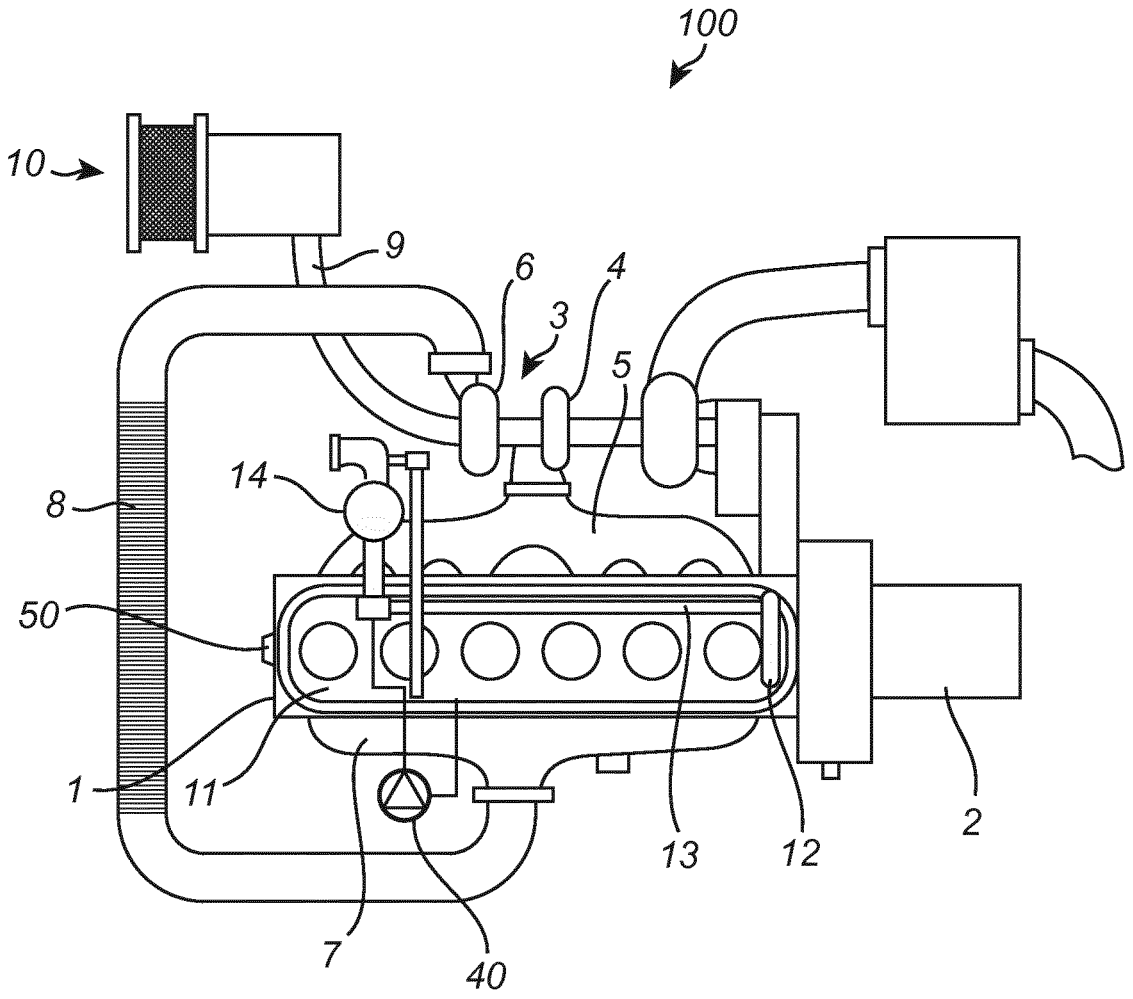
FIG. 2 shows a schematic overview of a combustion engine of FIG. 1 equipped with a separator to separate oil from blow-by gases in a crankcase.

FIG. 2 shows a schematic overview of parts of a combustion engine 100. In the non-limiting example of FIG. 2, the combustion engine 100 comprises an engine block 1 in a six-cylinder, four-stroke, diesel engine with a gear box 2 and a clutch that is connected to the engine's crankshaft. The crankshaft is at least partly comprised in the crankcase 11 of the combustion engine 100. In the example of FIG. 2, the combustion engine 100 is overloaded by means of a turbo compressor 3 of known type, which in turn comprises a turbine 4 connected to the engine's exhaust manifold 5 and a compressor 6 connected to the engine's induction (air intake) manifold 7 via an intercooler 8. By way of a suction pipe 9, the suction side of the compressor 6 is connected to an air filter 10. Moreover, the combustion engine 100 in FIG. 2 comprises a separator 14 for separating oil from blow-by gases in the crankcase 11, which will be further explained below.

Crankcase blow-by gases are generated in the combustion engine 100 and will escape from the respective combustion chamber of the combustion engine 100 and into the crankcase 11, which contains oil or lubricating oil, also referred to as engine oil or main gallery engine oil. The blow-by gases are slipped into the crankcase 11 as a consequence of non-sealed piston rings between the combustion engine's pistons and the inner walls in the respective cylinders. The blow-by gases contain small particles in the form of oil drops, which are desirable to separate from the gases.

The combustion engine 100 in FIG. 2 comprises a generally known screen separator 12 and a baffle separator 13 for guiding the blow-by gases in the crankcase 11. From the baffle separator 13, the crankcase gases are guided further into the separator 14 for separating the oil in the blow-by gases. Connected to the separator 14 is an oil sump via a drainage for draining the oil particles which have been separated by the separator 14, whereby the oil particles are enabled to be guided back to the oil sump. The oil may thereafter be guided back to the crankcase 11. A crankcase pressure sensor 50 is arranged to the crankcase 11 to detect the pressure inside the crankcase 11.

For the purpose of describing the present invention, the separator 14 can be a conventional separator e.g. as described in the publication of EP 1,085,945 B1. The separator 14 comprises, in the described embodiment of the present invention, a plurality of rotating discs which during rotation separates the oil droplets from the blow-by gas by means of the imparted centrifugal force.

As also shown in FIG. 2, the combustion engine 100 comprises an oil pump 40 configured for driving at least the separator 14. More specifically, the separator 14 is oil driven by means of circulating main gallery engine oil pressurized by means of the oil pump 40, to circulate throughout internal portions of the combustion engine 100 which is in need of lubricating oil.

Figure 3:
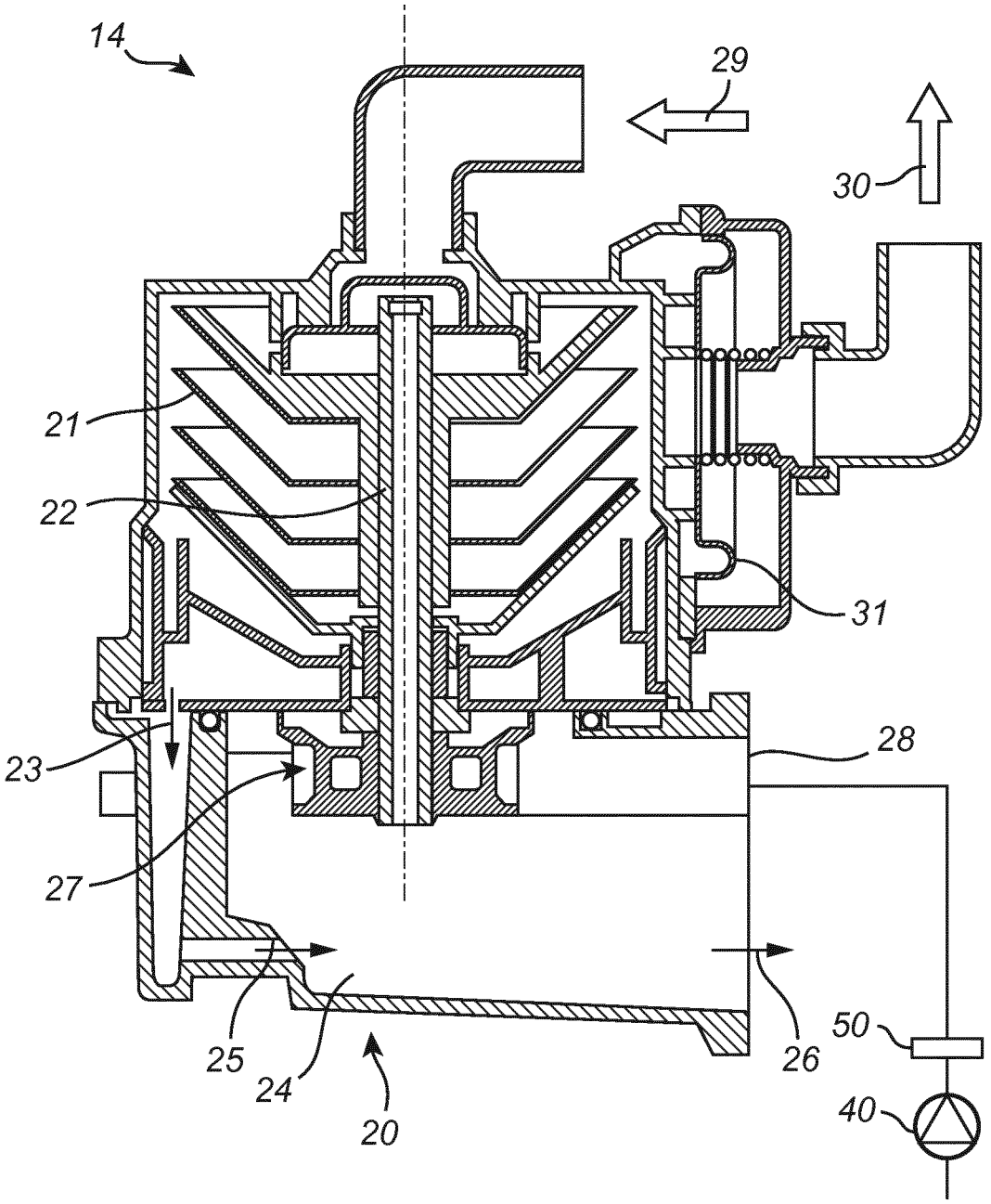
FIG. 3 shows a cross section of a separator which is used according to one embodiment of the invention.

The separator 14, and its co-operation with the oil pump 40, will now be described in greater detail with reference to FIG. 3. FIG. 3 shows a cross section of the separator 14 which can be utilized according to the present invention. However, it should be noted that other separators than that described with reference to FIG. 3 can be used according to the invention. The separator 14 comprises a housing 20 in which a plurality of oil separation members 21, here embodied as rotating discs 21, are arranged, each rotating disc 21 rotates around a rotating axis 22. As the blow-by gas passes the rotating discs 21, the oil droplets are imparted with a centrifugal force which throws the oil droplets towards the inner surface of the housing 20, at which the oil droplets are free to flow along the inner surface of the housing 20 towards a drainage 23. The drainage 23 drains the housing 20 from the separated oil droplets to an oil sump 24 via a check valve 25. The drained and separated oil can thereafter be guided back to the crankcase 11 via a crankcase conducting line 26. The housing 20 is further provided with an inlet opening 29 through which the unclean blow-by gas enters the separator 14 and an outlet opening 30 through which the cleaned gas exists the separator 14. As also shown in FIG. 3, a pressure regulator 31 is comprised in the separator 14 for pressure control of the housing 20 and the exiting gas.

In FIG. 3, the rotating discs 21 are rotated by means of a rotating means 27, here embodied as a drive turbine 27, which is fed with main galley engine oil via a turbine drive oil connection 28, which in this embodiment is in fluid communication with the crankcase 11. Moreover, as schematically shown in FIG. 3, a pressure sensor 50 is arranged downstream of the oil pump 40 in order to measure the oil pressure of the pressurized engine oil.

The present invention also relates to a method for controlling the oil pressure of an oil pump, such as oil pump 40 in FIG. 2 and FIG. 3 and oil pump 140 in FIG. 5 (described below), in a combustion engine comprising a crankcase and a separator for separating oil present in a blow-by gas from the crankcase, such as separator 14 in FIG. 2 and FIG. 3 and separator 114 in FIG. 5 (described below). Thus, the present invention will hereafter be described with reference to the above described combustion engine 100, crankcase 11 and separator 14, in a non-limiting way, with reference to the flow-chart in FIG. 4 (hence, the reference numerals of FIG. 2 and FIG. 3 are used below when describing the steps of the method in the flow-chart in FIG. 4).

In a first step 201, oil pressure demand for a set of different engine operation conditions is provided. The oil pressure demand defining the theoretical required oil pressure of the oil pump 40. That is, the combustion engine 100 may be operated in different engine operation conditions, for example dependent on the engine load and/or the engine speed. Thus, according to one embodiment, the first step 201 comprises determining the theoretical required oil pressure for the set of different engine operation conditions based on at least the engine load and/or engine speed.

The required oil pressure in the combustion engine 100 typically varies with the different engine operation conditions. Hence, for at least some engine operation conditions, the required oil pressure is relatively low, and for at least some engine operation conditions, the required oil pressure is relatively high (as will be described later with reference to FIG. 6, the oil pressure demand can be described as an oil pressure map showing the required oil pressure as a function of engine load and engine speed). For at least a set of such different engine operation conditions, the oil pressure demand for the theoretical required oil pressure of the oil pump 40 is provided. According to one embodiment, the oil pressure demand for the set of different engine operation conditions is predetermined.

In a second step 203, the oil pressure of said oil pump 40 is controlled based on the oil pressure demand for at least one engine operation condition in the set of different engine operation conditions. Hence, the oil pump 40 can be run more energy-efficient as the operation thereof corresponds to the oil pressure demand of the combustion engine. According to one embodiment, the oil pressure of said oil pump 40 is controlled based on the oil pressure demand for at least two different engine operation conditions in the set of different engine operation conditions.

In a third step 205, the separator 14 is driven using oil from the oil pump 40. Thus, the oil is pressurized based on the oil pressure demand. Hereby, the separator 14 can be driven, at least partly, in accordance with the oil pressure demand. In other words, the separator 14 can be driven with oil pressurized (by the oil pump 40) in accordance with the oil pressure demand, and hence the combustion engine 100, and the corresponding crankcase ventilation system, and oil pump 40 can be made more energy-efficient.

In a fourth, optional step 207, a first output signal O1 of a pressure sensor 50 arranged and configured to measure the oil pressure downstream of the oil pump 40 is detected. The first output signal O1 is indicative of a first engine operation condition in said set of different engine operation conditions.

In a fifth, optional step 209 the oil pressure of the oil pump 40 is controlled by comparing the first output signal O1 of the pressure sensor 50 with the oil pressure demand for an engine operation condition corresponding to the first engine operation condition. In other words, the theoretical required oil pressure (comprised in the oil pressure demand) is compared with the measured oil pressure. The comparison is typically made for corresponding engine operation conditions, and at corresponding positions within the combustion engine 100 (i.e. the same conditions applies for the theoretical required oil pressure and for the measured oil pressure).

As mentioned in relation to FIG. 3, the separator 14 may comprise at least one oil separation member 21 rotatably arranged in the separator 14. The at least one oil separation member 21 may be rotated by a rotating means 27. Thus, the third step 205 may comprise driving the rotating means 27 with oil from the oil pump 40, wherein the oil is pressurized based on the oil pressure demand.

Figure 5:
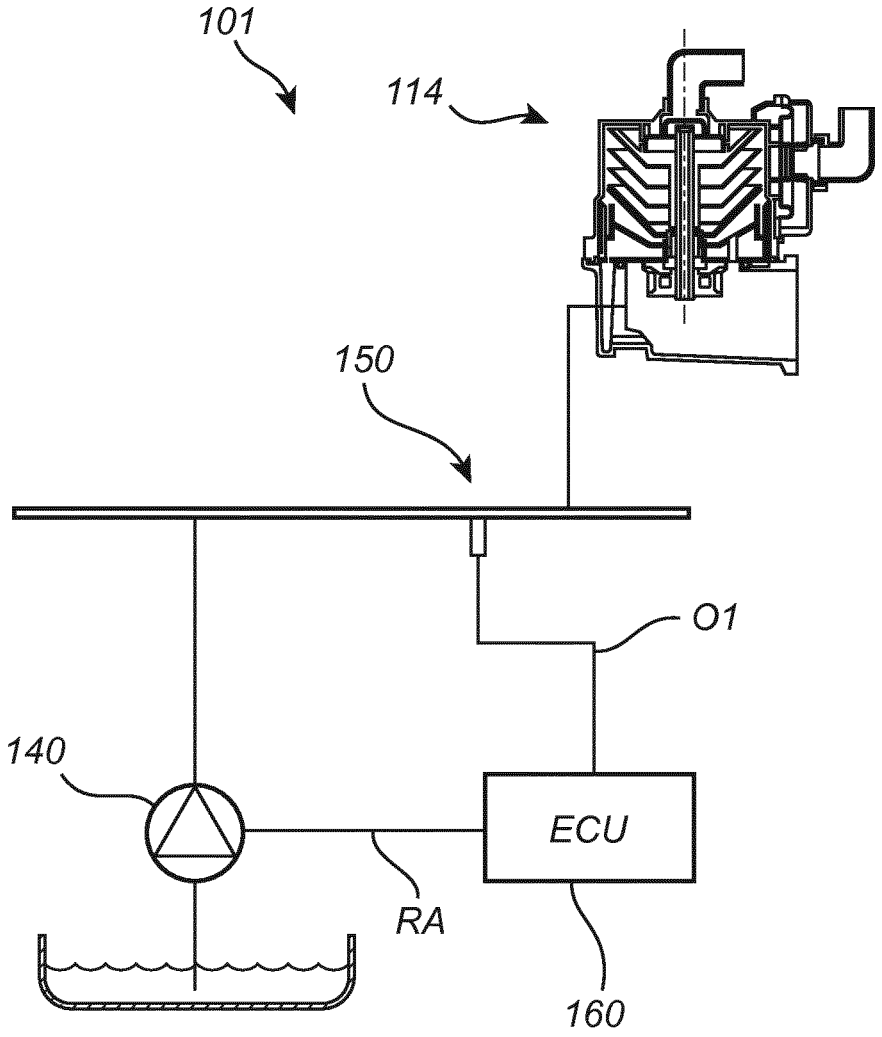
FIG. 5 is a schematic overview of a separator and an oil pressure arrangement according to one embodiment of the invention.

FIG. 5 shows an oil pressure arrangement 101 for a combustion engine, such as combustion engine 100 of FIG. 2. Thus, the oil pressure arrangement 101 of FIG. 5 may be comprised in the combustion engine 100 of FIG. 2. The oil pressure arrangement 101 comprises an oil pump 140, e.g. the same or similar to oil pump 40 of FIG. 2 and FIG. 3. The oil pump 140 may also be referred to as a controllable oil pump 140, configured for driving at least a separator 114 for separating oil present in blow-by gas from a crankcase. The separator 114 may be similar or the same as separator 14 of FIG. 2 and FIG. 3, but may as well be another type of separator, for example not comprising rotating discs 21, but instead e.g. a pressure drop driven separation device.

The oil pressure arrangement 101 further comprises a control unit 160 configured to control the oil pressure of the controllable oil pump 140 and a pressure sensor 150 arranged and configured to measure the oil pressure downstream of the oil pump 140, e.g. in the crankcase and/or in close proximity to the separator 114.

The function of the oil pressure arrangement 101 will now be described with reference to FIG. 5 and the method steps described in the flow-chart of FIG. 4. The control unit 160 in FIG. 5 is configured to control the oil pressure based on oil pressure demand for at least one engine operation condition in a set of different engine operation conditions. That is, the control unit 160 may be configured to perform at least some of the steps 201-209 (e.g. the first, second and third steps 201, 203, 205) of the method described with reference to the flow-chart in FIG. 4. The control unit 160 may comprise a computer program comprising program code means for performing at least some of the steps 201-209 (e.g. the first, second and third steps 201, 203, 205) of the method described with reference to the flow-chart in FIG. 4, when the program is run on the control unit. Moreover, the control unit 160 may comprise a computer readable medium carrying a computer program comprising program code means for performing at least some of the steps 201-209 (e.g. the first, second and third steps 201, 203, 205) described with reference to the flow-chart in FIG. 4, when said program product is run on the control unit 160. The control unit 160 may typically comprise a processor and a memory and may simply be referred to as a "computer".

Hence, control unit 160 may be configured to operate the oil pump 140 more energy-efficient as the operation of the oil pump 140 corresponds to the oil pressure demand of the combustion engine 100. Thus, at least indirectly, the control unit 160 may be configured to operate in such a way that the separator 114 can be driven, at least partly, in accordance with the oil pressure demand. In other words, the control unit 160 may be configured to operate such that the separator 114 can be driven with oil pressurized (by the oil pump 140) in accordance with the oil pressure demand, and hence, the combustion engine 100 and the oil pressure arrangement 101 can be made more energy-efficient.

As mentioned above, the oil pressure arrangement 101 may comprise a pressure sensor 150. The pressure sensor 150 is configured to send a first output signal O1 to the control unit 160, the first output signal O1 is indicative of a first engine operation condition in the previously described set of different engine operation conditions. Moreover, a comparison between the first output signal O1 of the pressure sensor 150 and the oil pressure demand, or at least one of the reference values in the oil pressure demand, carried out in the control unit 160 may initiate a response action RA for the oil pump 140. Hereby, the control unit 160 may be configured to control the oil pressure of the controllable oil pump 140 by comparing the first output signal O1 of the pressure sensor 150 with the oil pressure demand for an engine operation condition corresponding to the first engine operation condition.

Figure 6:
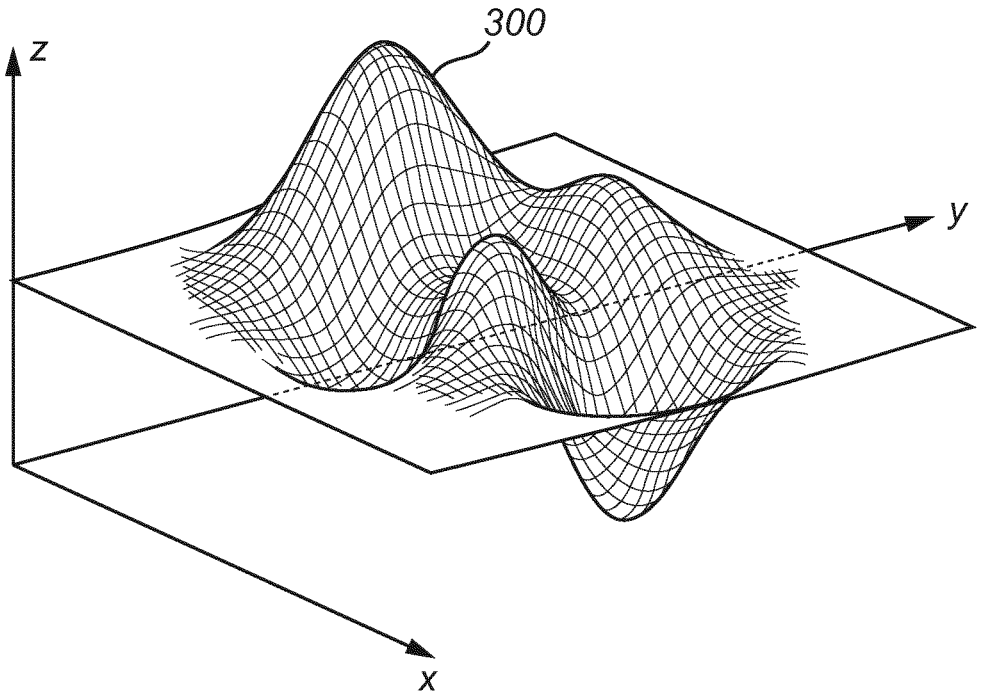
FIG. 6 is a graph showing an example of an oil pressure map according to one embodiment of the invention.

FIG. 6 is a graph showing an example of oil pressure demand embodied as an oil pressure map 300 according to one embodiment of the invention. As seen in FIG. 6, the oil pressure map 300 corresponds to a 3D map 300, which can be described in an x, y, z-coordination system in which the x-axis represents the engine speed, the y-axis represents the engine load, and the z-axis represents the theoretical required oil pressure. Thus, it should be understood that in FIG. 6, the oil pressure demand, or oil pressure map 300, for the set of different engine operation conditions is predetermined. That is, the oil pressure demand, or oil pressure map 300, has been determined on beforehand, for example based on empirical studies and/or be based on theoretical calculations, i.e. to provide the theoretical required oil pressure for at least one, two, or more of engine operation condition(s) in the set of different engine operation conditions. For example, and as previously described, the combustion engine 100, or a typical engine of an engine type corresponding to the combustion engine 100, may be set up in an engine test-rig which is run for at least the engine operation conditions in the set of different engine operation conditions. For each different engine operation condition, here based on at least a specific engine speed and a specific engine load, the required oil pressure needed to be delivered from the oil pump 40, 140 is determined and saved as theoretical required oil pressures in the oil pressure demand or oil pressure map 300. As shown in FIG. 6, the theoretical required oil pressure may thus be mapped in relation to the engine operation conditions in the form of engine speed and engine load. By saving/storing the oil pressure map 300, or at least the values of the theoretical require oil pressure and its relation to the engine speed and engine load, in for example the control unit 160, the data (i.e. the oil pressure demand or oil pressure map 300) may subsequently be used to control the operation of the oil pump 40, 140, and the separator 14, 114 during normal operation of the combustion engine 100.

Stated differently, by using an engine test-rig, and performing engine tests and calculations, the requirement of e.g. the separator 14, 114 (that is the oil pressure needed to fulfil the separation requirements, which may correspond to e.g. the rotational speed of the rotating means 27) in every engine operation condition in the set of different engine operation conditions, can be determined as the theoretical required oil pressure. In the control unit 160, these values are stored and thus the required oil pressure of the separator 14, 114 is known for each engine operation condition in the set of different engine operation conditions. By comparing the required oil pressure value with the measured oil pressure value, the control unit 160 can adjust the response action RA to the oil pump 40, 140 (or an oil pressure control valve regulating the oil pump 40, 140) until the measured oil pressure value correspond to the required oil pressure value.

Figure 4:
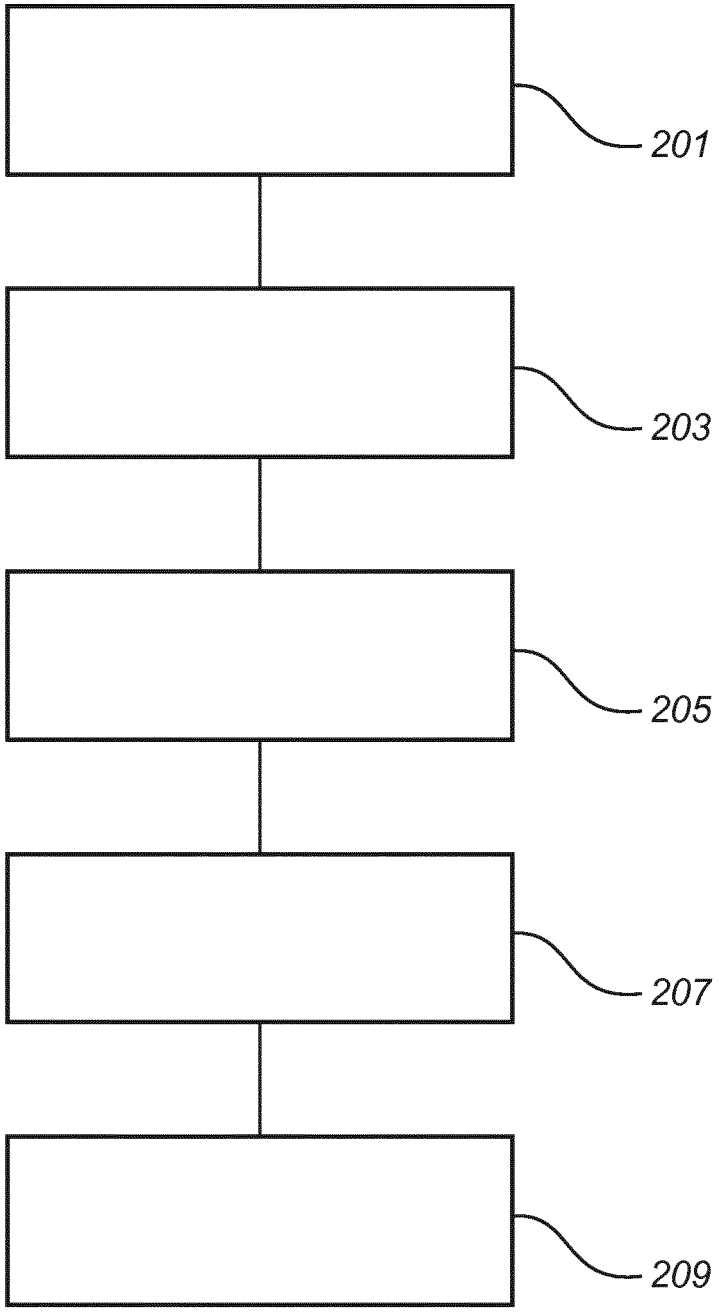
FIG. 4 is a flow chart describing the steps of a method for controlling the oil pressure of an oil pump, according to one embodiment of the invention.

Thus, with reference to the method described in FIG. 4, the first step 201 may comprise providing an oil pressure map 300, wherein the oil pressure map 300 comprises the theoretical required oil pressure for the set of different engine operation conditions based on at least the engine load and the engine speed.

It is to be understood that the present invention is not limited to the embodiments described above and illustrated in the drawings; rather, the skilled person will recognize that many changes and modifications may be made within the scope of the appended claims. For example, as already mentioned the separator may be of another structure than that described in herein.

The invention claimed is:

1. A method for controlling oil pressure of an oil pump in a combustion engine, the combustion engine comprising a crankcase and a separator for separating oil present in a blow-by gas from the crankcase, the method comprising providing an oil pressure demand for a set of different engine operation conditions, the oil pressure demand defining a theoretical required oil pressure of the oil pump, wherein the theoretical required oil pressure is determined based on at least an amount of blow-by gases in the crankcase;

controlling the oil pressure of the oil pump based on the oil pressure demand for at least one engine operation condition in the set of different engine operation conditions;

driving the separator using oil from the oil pump, the oil being pressurized based on the oil pressure demand.

2. The method according to claim 1, wherein the step of providing the oil pressure demand comprises determining the theoretical required oil pressure for the set of different engine operation conditions based on at least the engine load and/or engine speed.

3. The method according to claim 1, wherein the oil pressure demand for the set of different engine operation conditions is predetermined.

4. The method according to claim 1, wherein the step of providing the oil pressure demand comprises providing an oil pressure map, the oil pressure map determining the theoretical required oil pressure for the set of different engine operation conditions based on at least the engine load and the engine speed.

5. The method according to claim 1, wherein a further step of the method is detecting a first output signal of a pressure sensor arranged and configured to measure the oil pressure downstream of the oil pump, the first output signal being indicative of a first engine operation condition in the set of different engine operation conditions.

6. The method according to claim 5, wherein a further step of the method is controlling the oil pressure of the oil pump by comparing the first output signal of the pressure sensor with the oil pressure demand for an engine operation condition corresponding to the first engine operation condition.

7. The method according to claim 1, wherein the separator comprises an oil separation member rotatably arranged in the separator, the oil separation member being rotated by a rotating means, wherein a further step is driving the rotating means with oil from the oil pump, the oil being pressurized based on the oil pressure demand.

8. A control unit for controlling the oil pressure of the oil pump configured for driving at least the separator for separating oil present in blow-by gas from the crankcase, the control unit being configured to perform the method according to claim 1.

9. An oil pressure arrangement for a combustion engine comprising:

an oil pump configured for driving at least a separator for separating oil present in blow-by gas from a crankcase, and a control unit configured to control the oil pressure of the oil pump wherein the control unit is configured to determine a theoretical required oil pressure for the oil pump, the theoretical required oil pressure being based on at least on an amount of blow-by gases in the crankcase; and control the oil pressure based on an oil pressure demand for at least one engine operation condition in a set of different engine operation conditions, wherein the oil pressure demand defines the theoretical required oil pressure of the oil pump.

10. The oil pressure arrangement according to claim 9, comprising a pressure sensor arranged and configured to measure the oil pressure downstream of the oil pump, the pressure sensor being configured to send a first output signal to the control unit, the first output signal being indicative of a first engine operation condition in the set of different engine operation conditions, wherein the control unit is configured to control the oil pressure of the oil pump by comparing the first output signal of the pressure sensor with the oil pressure demand for an engine operation condition corresponding to the first engine operation condition.

11. The oil pressure arrangement according to claim 9, wherein the control unit is configured to perform the method.

12. A vehicle comprising the oil pressure arrangement according to claim 9.

* * * * *